US010947694B2

(12) United States Patent
You et al.

(10) Patent No.: US 10,947,694 B2
(45) Date of Patent: Mar. 16, 2021

(54) PRELOADING APPARATUS FOR ADJUSTING LOAD AND METHOD OF REINFORCING FOUNDATION USING THE SAME

(71) Applicant: KOREA INSTITUTE OF CIVIL ENGINEERING AND BUILDING TECHNOLOGY, Gyeonggi-Do (KR)

(72) Inventors: Young Chan You, Gyeonggi-do (KR); Ki Sun Choi, Gyeonggi-do (KR); Hyun Jee Lee, Incheon (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 0 days.

(21) Appl. No.: 16/615,824

(22) PCT Filed: Sep. 26, 2019

(86) PCT No.: PCT/KR2019/012487
§ 371 (c)(1),
(2) Date: Nov. 22, 2019

(87) PCT Pub. No.: WO2021/002534
PCT Pub. Date: Jan. 7, 2021

(65) Prior Publication Data

US 2021/0002848 A1 Jan. 7, 2021

(30) Foreign Application Priority Data

Jul. 4, 2019 (KR) ..... 10-2019-0080667

(51) Int. Cl.
*E02D 35/00* (2006.01)
*E02D 27/48* (2006.01)
(Continued)

(52) U.S. Cl.
CPC ..... *E02D 35/00* (2013.01); *E02D 27/48* (2013.01); *E02D 35/005* (2013.01); *E02D 5/56* (2013.01); *E02D 27/28* (2013.01); *E04B 1/3511* (2013.01)

(58) Field of Classification Search
CPC ..... E02D 35/00; E02D 35/0005; E02D 27/48
(Continued)

(56) References Cited

U.S. PATENT DOCUMENTS 4,678,373 A * 7/1987 Langenbach, Jr. ..... E02D 27/48 405/230
5,217,325 A * 6/1993 Freeman, III ..... E02D 27/48 405/229
(Continued)

FOREIGN PATENT DOCUMENTS

EP 2458095 * 5/2012

*Primary Examiner* — Frederick L Lagman
(74) *Attorney, Agent, or Firm* — JCIPRNET

(57) ABSTRACT

The present invention relates to a preloading apparatus and a method of reinforcing a foundation using the same, wherein, in a preloading method used for remodeling construction in which an extension of a building, such as an apartment, is required, the preloading apparatus allows adjustment of a preloading load, such as addition of a preloading load, to be performed when loss of the preloading load occurs and allows the new pile to effectively share a load applied before and after an extension of a building so that reinforcement efficiency is increased, and thus a load is adjustable economically.

13 Claims, 8 Drawing Sheets

(51) Int. Cl.
*E04B 1/35* (2006.01)
*E02D 5/56* (2006.01)
*E02D 27/28* (2006.01)

(58) Field of Classification Search
USPC ..... 405/230
See application file for complete search history.

(56) References Cited

U.S. PATENT DOCUMENTS

| | | | | |
|---|---|---|---|---|
| 5,722,798 | A * | 3/1998 | Gregory | B66F 1/025 254/133 R |
| 5,951,206 | A * | 9/1999 | Gregory | E02D 35/00 405/229 |
| 7,300,230 | B2 * | 11/2007 | Ong | E02D 35/00 405/230 |
| 7,967,531 | B2 * | 6/2011 | Collina | E04G 23/065 405/230 |
| 8,926,227 | B2 * | 1/2015 | Zago | E02D 35/00 405/230 |
| 2002/0176749 | A1 * | 11/2002 | Provost | E02D 35/00 405/230 |
| 2009/0260315 | A1 | 10/2009 | Hodge | |
| 2012/0114423 | A1 * | 5/2012 | Zago | E02D 35/00 405/230 |
| 2014/0255105 | A1 * | 9/2014 | Asplin | E02D 37/00 405/230 |
| 2018/0127941 | A1 | 5/2018 | Halonen et al. | |
| 2018/0363268 | A1 * | 12/2018 | Asplin | E02D 35/005 |

* cited by examiner

PRELOADING APPARATUS FOR ADJUSTING LOAD AND METHOD OF REINFORCING FOUNDATION USING THE SAME

CROSS-REFERENCE TO RELATED APPLICATION

This application is a 371 of international application of PCT application serial no. PCT/KR2019/012487, filed on Sep. 26, 2019, which claims the priority benefit of Korean application no. 10-2019-0080667, filed on Jul. 4, 2019. The entirety of each of the abovementioned patent applications is hereby incorporated by reference herein and made a part of this specification.

FIELD OF THE INVENTION

The present invention relates to a preloading apparatus for adjusting a load and a method of reinforcing a foundation using the same. More specifically, the present invention relates to a preloading apparatus for adjusting a load which allows adjustment of a preloading load, such as addition of a load, to be performed and allows a new pile to receive loads applied before and after the extension so that reinforcement efficiency is increased to achieve construction economically when loss of an applied preloading load occurs in a preloading method used for remodeling construction for an extension of a building such as an apartment, and a method of reinforcing a foundation using the same.

DESCRIPTION OF RELATED ART

FIGS. 1*a* and 1*b* are shop drawings illustrating a conventional preloading method.

That is, it can be confirmed that an existing structure includes a footing 1 and a column 2 formed in the center of the footing.

Therefore, a load transferred from the column 2 is transferred to existing piles 3 through the footing 1.

In this case, when the existing structure is extended, the load transferred from the column 2 is increased, and thus bearing capacity of the pile 3 is not enough to bear the load. Therefore, a new pile 10 is additionally constructed on the footing 1.

The new pile 10 has a relatively small diameter, and micro-piles that are easily constructed are commonly used as the new pile 10. To construct the new pile 10, through holes G2 are formed by passing through the footing 1, the excavation hole G1 is formed by excavating the ground under the footing 1, then the micro-piles are inserted into the through holes G2 and the excavation hole G1 to a predetermined depth, head parts of the micro-piles are anchored in the excavation hole G2 of the footing 1, and the through holes G1 are filled with a filling material for finishing.

In this case, the bearing capacity of the micro-piles is maintained by frictional force between external surfaces of the micro-piles and the filling material, but when construction management is not performed properly, it is difficult to secure a required bearing capacity.

In the conventional preloading method, a prestress P (a preloading load) is applied downward before the head parts of the micro-piles are anchored to the footing 1, and the head part is anchored to the footing 1, and thus end bearing capacity and frictional force can be effectively secured.

Therefore, the conventional preloading method necessarily requires a preloading device 20 for applying a prestress downward to the new pile 10 constructed on the footing 1.

As shown in FIGS. 1*a* and 1*b*, a screw device is installed as the preloading device 20 between a triangular support and the head parts of the micro-piles, and since a screw vertically expands by rotating, a prestress can be applied downward due to a reaction force. To effectively secure the reaction force, a reaction support 30 may be additionally installed between the triangular support and a lower surface of a first floor-slab 5.

FIGS. 1*c* and 1*d* are shop drawings illustrating another conventional preloading method.

That is, in the conventional preloading method, since the new pile 10 is constructed on the footing 1, the footing 1 should have a free space in which the new pile 10 is constructed, and the new pile 10 should effectively receive existing and additional loads transferred from the existing pile 3 and a column.

However, when the footing 1 does not have the free space in which the new pile 10 is constructed, an extension footing 4 is additionally constructed on a lateral side of the footing 1, the new pile 10 is constructed on the extension footing 4, and the extension footing 4 is integrated with the footing 1 so that the extension footing 4 and the footing 1 are integrally moved.

Therefore, while the extension footing 4 and the footing 1 are integrally moved, the existing pile 3 and the new pile 10 share the load transferred from the column.

However, in such a conventional preloading method, a case of loss of the downward prestress applied to the new pile 10 occurs when time elapses, but even when the downward prestress (a preloading load) is additionally applied, the head parts of the micro-piles are already constructed on the footing to be anchored as shown in portion A, and thus tasks cannot be performed.

Therefore, a problem occurs that the load that the existing pile 3 receives is increased more than the existing load due to loss of the preload.

Further, since the new pile 10 is spaced apart from the column 2 more than the existing pile 3, a problem occurs in which an axial load that the extension footing 4 receives is decreased due to deformation of the extension footing 4 and the footing 1. Therefore, in the conventional preloading method, in actuality, a case occurs in which new piles are additionally installed, and thus there is a limit in that economic feasibility can do nothing but be degraded.

BRIEF SUMMARY OF THE INVENTION

Technical Problem

The present invention is directed to providing a preloading apparatus and a method of reinforcing a foundation using the preloading apparatus, wherein, in a preloading method that applies a preloading load to a new pile constructed on a footing and anchors a head part of the new pile to the footing, the preloading apparatus allows adjustment of a preloading load, such as addition of a preloading load, to be performed, even in the event of loss of the preloading load occurring, and allows the additionally installed new pile to effectively share a load transferred to the existing pile so as to secure economic feasibility when footing reinforcement is required in the event of remodeling an apartment and the like, and thus loads are adjustable effectively.

Technical Solution

One aspect of the present invention provides a preloading apparatus for adjusting a load which includes a new footing which is separate from and not in contact with an existing footing and constructed in the ground (G), an upper supporting plate which is integrated with an existing slab and an existing vertical part, which are formed on the existing footing, and formed above the new footing, and a loading unit installed between the new footing and the upper supporting plate, wherein, when the loading unit is operated, the upper supporting plate connected with the existing vertical part and the existing slab is used as an reaction bed so that a preloading load is applied to a new pile of the new footing, and thus the new pile may share an existing load and an extension load applied before and after an extension of a building through the existing vertical part and the existing slab.

Also, preferably,

The new pile may be constructed in a manner in which the new pile is rotatably pressed-fitted into the ground next to the existing footing or is inserted into an excavation hole and the excavation hole is filled with a filling material for finishing, wherein a head part of the new pile may be integrally buried in the new footing, and the new pile may be provided as a plurality of new piles formed to be separate from each other in a longitudinal direction.

Also, preferably,

The new footing may be provided as a plurality of new footings each formed in the ground as a single footing to be separate from each other in a longitudinal direction, or the new footings may be each formed in the ground as a strip footing continuously extending in a longitudinal direction.

Also, preferably,

The loading unit may be installed between the new footing and the upper supporting plate to serve to apply a preloading load to the new pile and adjust the preloading load by repeatedly adding a preloading load at different times.

Also, preferably,

The loading unit may be adjusted in a manual or automatic manner and a wired or wireless manner using a mechanical device or a hydraulic jack and a control system.

Also, preferably,

In the upper supporting plate, an upper support may be integrated with the existing vertical part and the existing slab of an existing structure, and an upper footing may be integrally formed with a lower portion of the upper supporting plate so that a lower surface of the upper footing may be in contact with an upper surface of the loading unit.

Also, preferably,

In the upper supporting plate, an upper footing may be integrated with the existing vertical part and the existing slab of an existing structure, and an upper support may be integrally formed with a lower portion of the upper footing so that a lower surface of the upper support may be in contact with an upper surface of the loading unit.

Also, preferably,

The upper supporting plate may be formed in a vertical wall in which an upper footing is formed as a block extending by a predetermined length to correspond to a new lower support and is integrally formed with a lower portion of an upper support, and the upper support may be integrated with the existing vertical part and the existing slab.

Also, preferably,

The upper supporting plate may include an upper footing having a horizontal plate form and upper supports, which are formed on an upper surface of the upper footing in a vertical wall form and spaced apart from each other, and may be formed as a wall member having a U-shaped cross-section, the upper footing may be formed as an extending horizontal plate to correspond to a new lower support, and the upper supports having a vertical wall form may be integrated with the existing vertical part and the existing slab.

Another aspect of the present invention provides a method of reinforcing a foundation using a preloading apparatus which includes (a) constructing a new pile in the ground (G) to be separate from and not in contact with an existing footing and integrating the new pile with a new footing, (b) integrating an upper supporting plate with an existing slab and an existing vertical part, which are formed in an existing footing, to be positioned above the new footing, and (c) installing a loading unit between the new footing and the upper supporting plate and operating the loading unit to apply a preloading load to the new pile of the new footing by using the upper supporting plate, which is connected with the existing vertical part and the existing slab, as a reaction bed.

Advantageous Effects

According to the present invention, unlike the conventional preloading method, when a reaction force of an existing pile exceeds design bearing capacity, an additional preloading load can be applied, and thus bearing capacity of the existing pile can be more efficiently secured through adjustment of the preload.

Further, according to the present invention, a new footing is constructed to be separate from an existing footing and is connected with an existing column and an existing slab through a loading unit and an upper supporting plate so as to increase a load sharing rate of the new pile when comparing before and after the extension, and thus the footing can be efficiently reinforced due to reduction of the new pile construction.

DETAILED DESCRIPTION OF THE INVENTION

Best Mode of the Invention

Figure 1B:
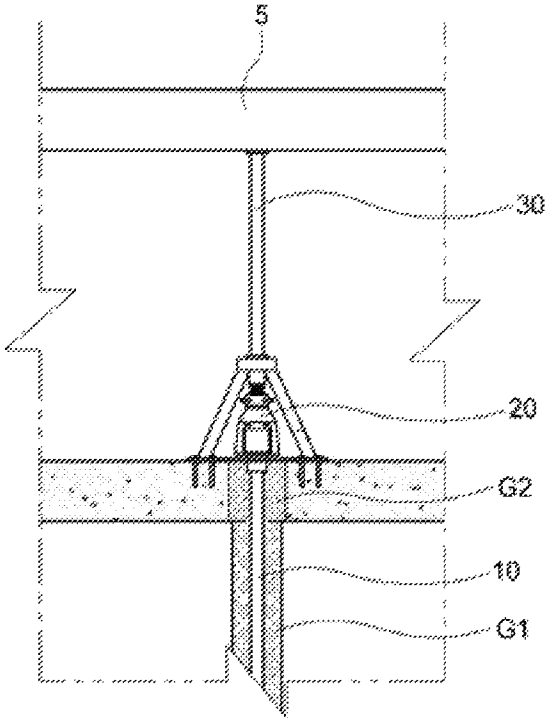
FIG. 1b (Prior Art)
FIGS. 1*a*, 1*b*, 1*c* and 1*d* are shop drawings of conventional preloading methods.
Figure 1A:
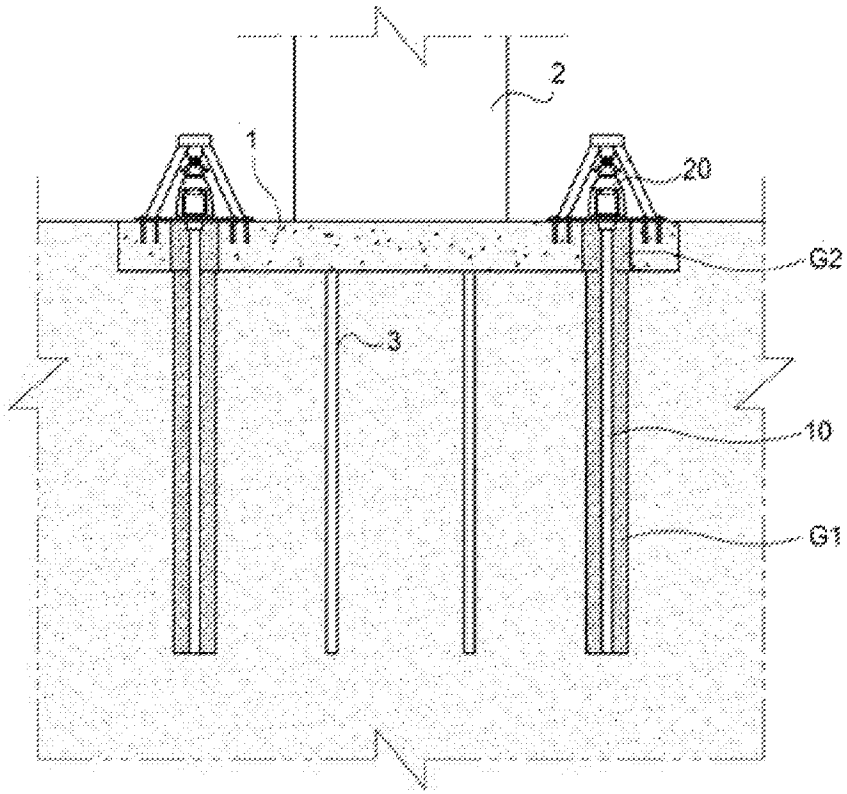
FIG. 1a (Prior Art)
Figure 1D:
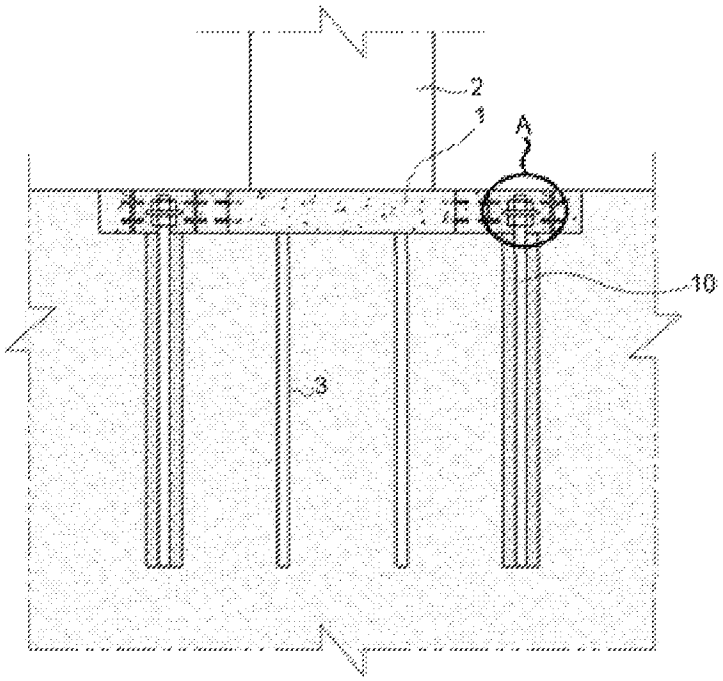
FIG. 1d (Prior Art)
Figure 1C:
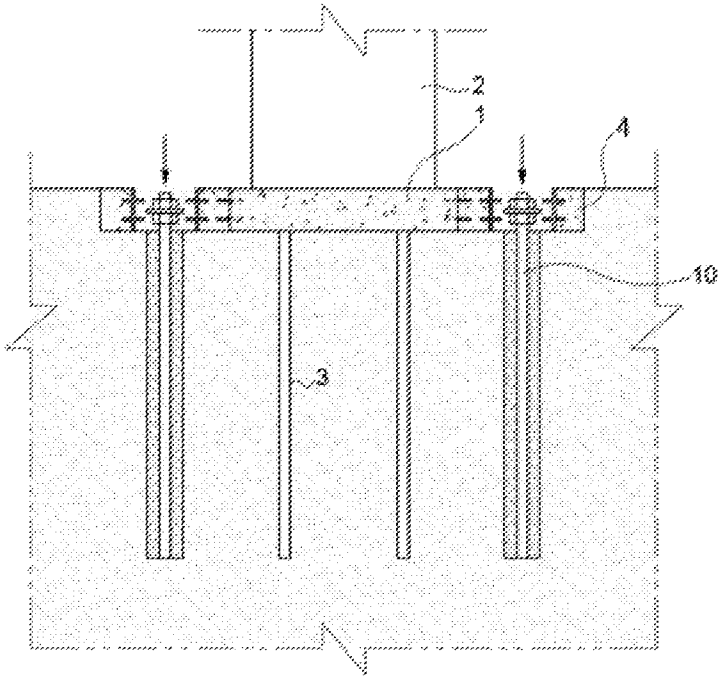
FIG. 1c (Prior Art)

The preloading apparatus includes a new footing which is separate from and not in contact with an existing footing and constructed in the ground, an upper supporting plate which is integrated with an existing vertical part, which is formed on the existing footing, and an existing slab and is formed on an upper portion of the new footing, and a loading unit installed between the new footing and the upper supporting plate. The preloading apparatus operates the loading unit and uses the upper supporting plate, which is connected with the existing vertical part and the existing slab, as a reaction bed so as to apply a preloading load to a new pile of the new footing and allows the new pile to share an existing load and an extension load applied before and after an extension of a building through the existing vertical part and the existing slab.

Modes of the Invention

Hereinafter, embodiments that are easily performed by those skilled in the art will be described in detail with reference to the accompanying drawings. However, the embodiments of the present invention may be implemented in several different forms and are not limited to embodiments described herein. In addition, parts irrelevant to description will be omitted in the drawings to clearly explain the embodiments of the present invention. Similar parts are denoted by similar reference numerals throughout this specification.

Throughout the specification, when a portion "includes" an element, the portion may include the element or another element may be further included therein, unless otherwise described.

Figure 2A:
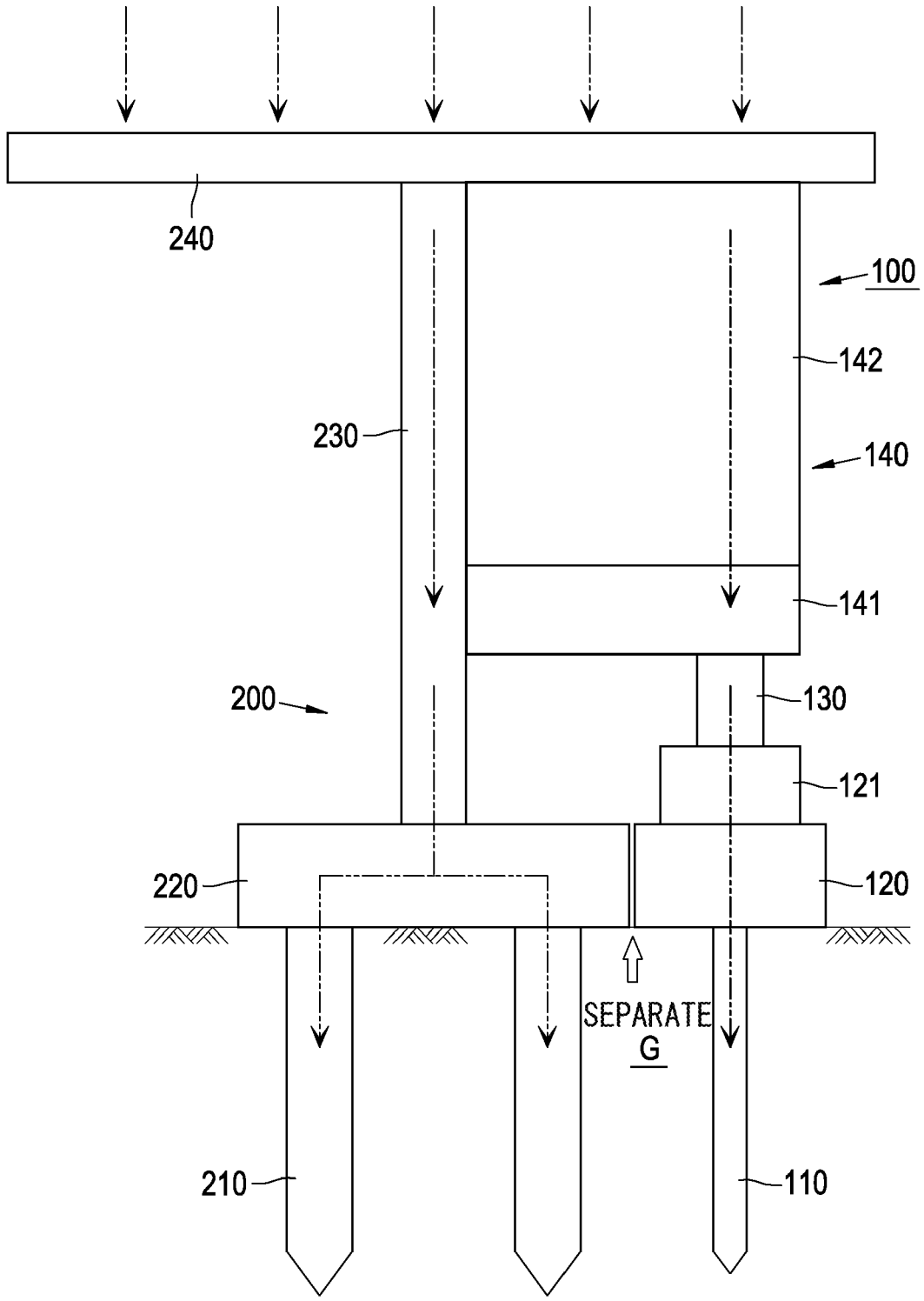
FIGS. 2*a* and 2*b* are configuration views of a preloading apparatus for adjusting a load according to a present invention.
Figure 2B:
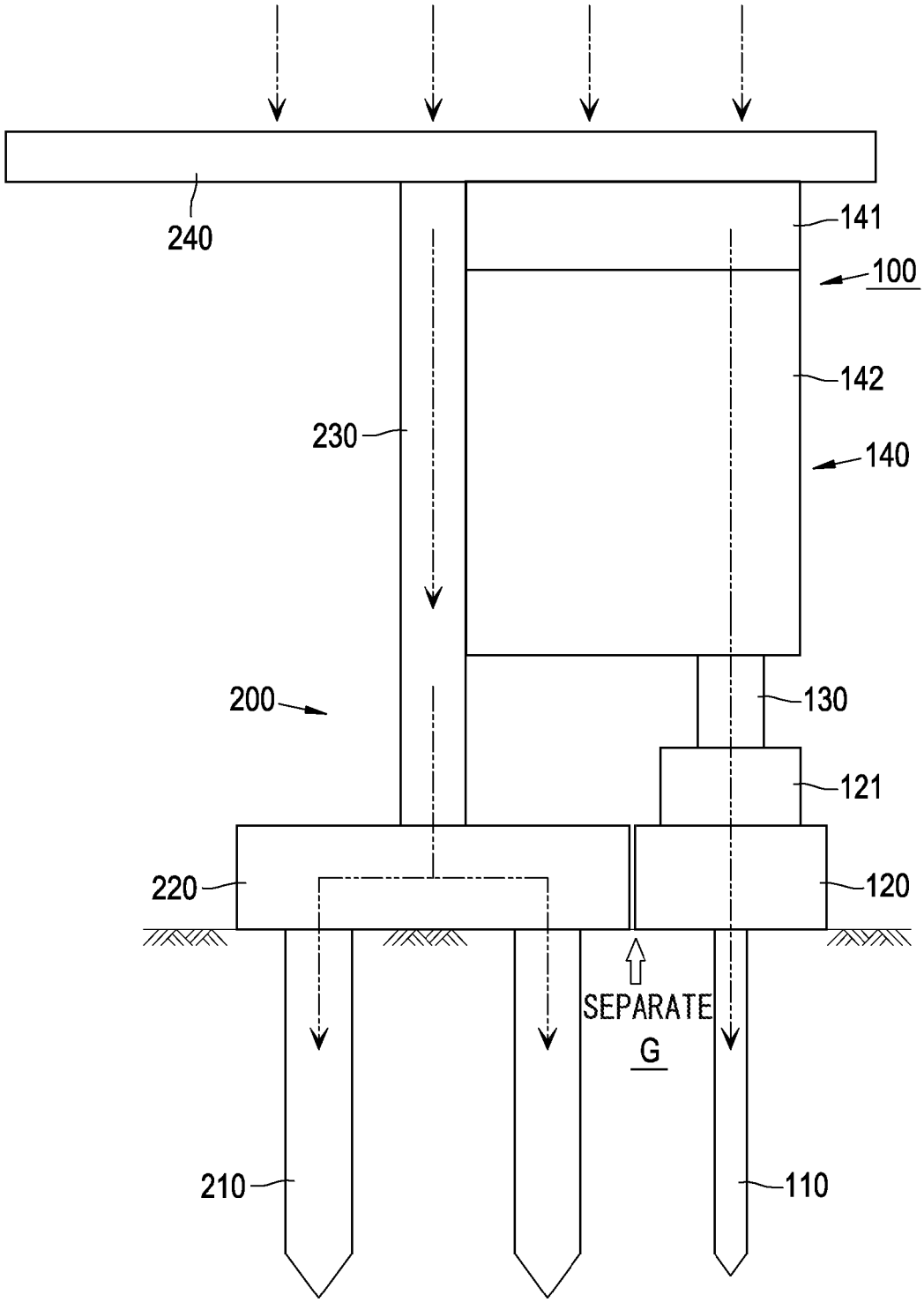

Preloading Apparatus 100 for Adjusting a Load According to the Present Invention FIGS. 2*a* and 2*b* are configuration views of the preloading apparatus for adjusting a load according to the present invention.

A preloading apparatus 100 for adjusting a load according to the present invention includes a loading unit 130, such as a hydraulic jack or a mechanical device that performs adjustment of a preloading load, such as repetition and addition of a preloading load, and a new footing 120 that is separate from an existing footing 220, wherein the new footing 120 is connected with an existing vertical part 230 and an existing slab 240 through the loading unit 130 and an upper supporting plate 140 so that a new pile 110 may effectively share existing or extension loads applied before and after an extension of a building.

As shown in FIGS. 2*a* and 2*b*, the preloading apparatus 100 for adjusting a load includes the new pile 110, the new footing 120, the loading unit 130, and the upper supporting plate 140 that are separately formed on an existing structure 200. In this case, the existing structure 200 includes an existing pile 210, the existing footing 220, the existing vertical part 230, and the existing slab 240.

First, as shown in FIGS. 2*a* and 2*b*, the new pile 110, which is a pile previously constructed on the ground under the new footing 120, is separately constructed in the ground G on a lateral side of the existing footing 220 and mainly uses micro-piles that are connectable.

To construct the micro-piles, the micro-piles may be directly pressed-fitted into the ground under the new footing 120 by rotating or may be inserted into excavation holes, which are formed through excavation, and the excavation holes may be filled with a filling material for finishing. In this case, the plurality of micro-piles are installed to be separate from each other.

A head part of the new pile 110 is integrated with the new footing 120 described below, and generally, a predetermined thickness of footing concrete is poured on the head parts of the micro-piles so that the head parts of the micro-piles are integrated with the new footing 120.

As shown in FIGS. 2*a* and 2*b*, the new footing 120 is a footing newly constructed on a lateral side of the existing footing 220, and conventionally, the footing is integrally constructed with the existing footing 220, but in the present invention, the new footing 120 is not integrated with but separate from the existing footing 220.

Therefore, since the new footing 120 is constructed not to be integrated with but separate from the existing footing 220, the new footing 120 moves independently from the existing footing 220, and thus the new pile 110 and the existing pile 210 effectively share an existing load and an added load transferred from the existing slab and the existing vertical part.

That is, in the conventional preloading method, since the new footing 120 is integrated with the existing footing 220, the new footing 120 and the existing footing 220 integrally move, and thus there is a problem in that the existing pile 210 has a larger load sharing rate than the new pile 110. However, the new footing 120 is constructed to be separate from the existing footing 220 to solve the problem.

Unlike the conventional invention, in the present invention, a footing integration construction that extracts a reinforcement bar from the existing footing 220, connects the reinforcement bar with a reinforcement bar extracted from the new footing 120, and pours concrete is not required, and thus a construction process may be simplified.

Figure 3A:
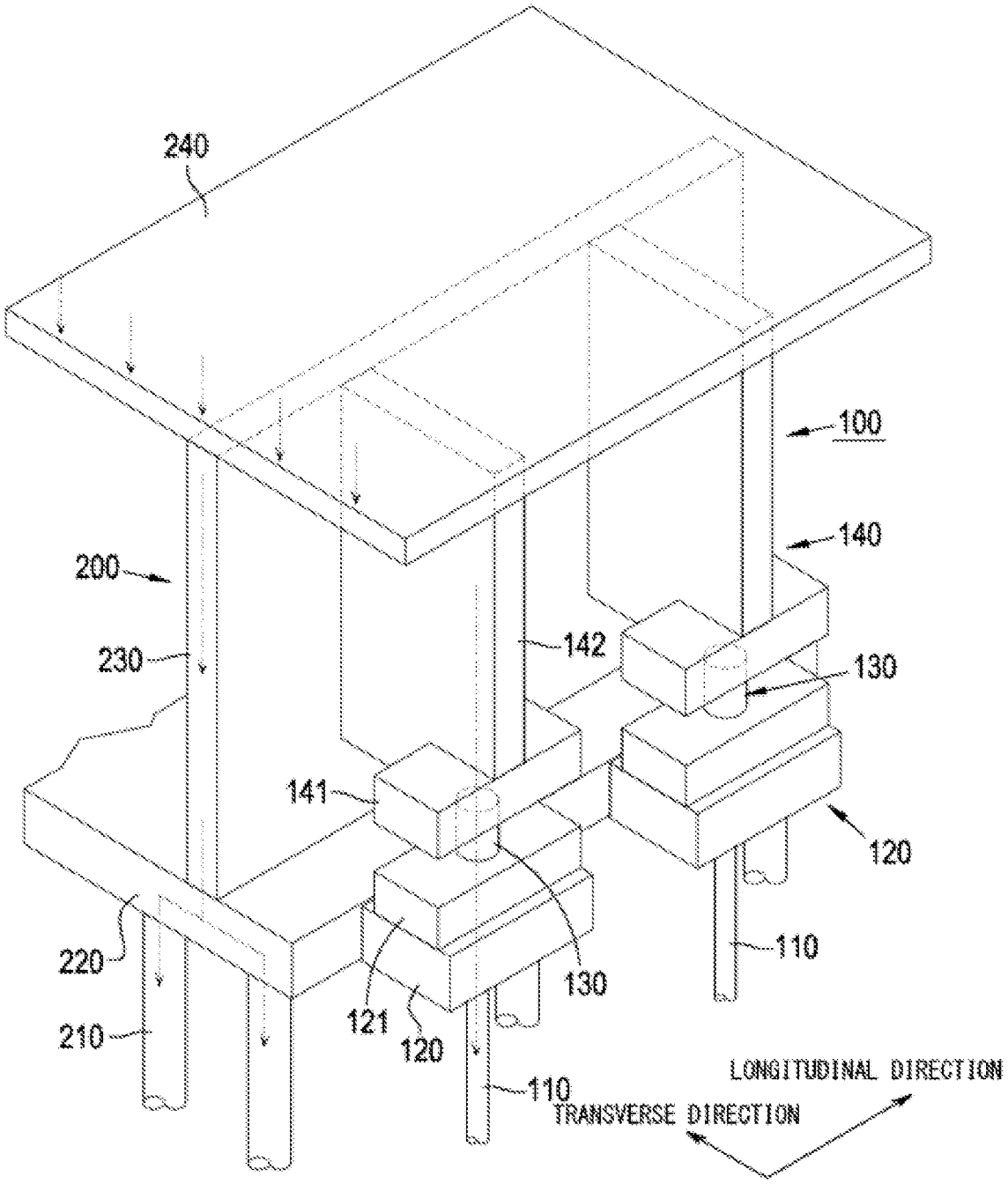
FIGS. 3*a* and 3*b* are views illustrating the preloading apparatus for adjusting a load according to the present invention.
Figure 3B:
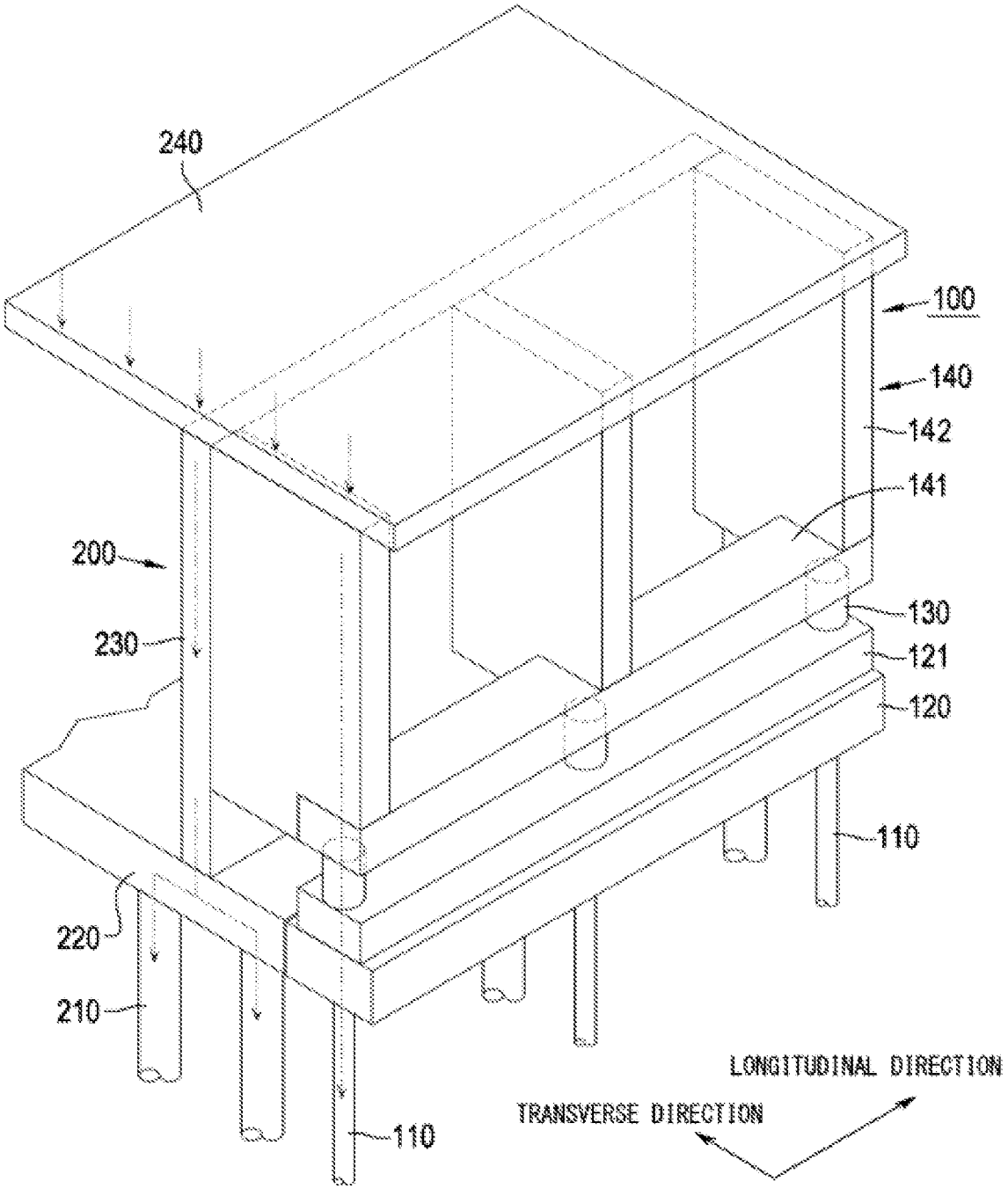

As shown in FIGS. 3*a* and 3*b*, the new footings 120 may each be separately constructed as a single footing or may be continuously constructed as a strip footing, and the new footings 120 may be constructed in a manner that arranges required reinforcement bars and pours and cures a predetermined thickness of concrete to be integrated with a front portion of the new pile 110.

Further, a new lower support 121 may be further integrally formed with an upper portion of the new footing 120. In this case, when a preloading load is directly transferred to the new footing 120 by the loading unit 130, stress concentration may occur, and thus the new lower support 121 may be integrally or separately formed on the upper portion of the new footing 120 in an independent block form in a longitudinal direction to distribute and transfer the preload.

As shown in FIGS. 2*a* and 2*b*, the loading unit 130 is installed between the new footing 120 and the upper supporting plate 140 described below to serve to apply a prestress, that is, a preloading load, downward to the new pile 110 and serves to adjust the preloading load by repeatedly adding the preloading load at different times.

That is, the loading unit 130 is positioned on a lower surface of the upper supporting plate 140, and the upper supporting plate 140 is connected to the existing vertical part 230 and the existing slab 240, and thus, when the loading unit 130 is operated, the preloading load may be applied to the new pile 110 through the new footing 120 as a reaction force for force applied to the upper supporting plate 140.

Therefore, when a mechanical device that vertically extends, such as a screw jack or a hydraulic jack and a control system, is used as the loading unit, operations of the loading unit 130 may be adjusted in a manual or automatic manner and a wired or wireless manner. When the preloading load that does not meet a reference level is applied or when loss of the preloading load due to passage of time occurs, an additional preloading load may be applied immediately. Since the additional preloading load is immediately applied when loss of the preloading load is maximized after an extension of the building, efficiency can be greatly increased and the construction of the new pile 110 can be minimized, and thus economic feasibility can be secured.

When the new footing 120 is a single footing, at least one loading unit 130 is installed on the single footing, and when the new footing 120 is a strip footing, the plurality of loading units 130 are installed to be separate from each other.

As shown in FIGS. 2*a* and 2*b*, the upper supporting plate 140 serves as a reaction bed of the loading unit 130 and also serves to transfer loads (existing and extension loads), which are transferred from above, to the loading unit 130, the new footing 120, and the new pile 110.

To this end, the upper supporting plate 140 is connected with the existing vertical part 230 and the existing slab 240 of the existing structure 200 so as to transfer the loads and serves as reaction beds of the existing vertical part 230 and the existing slab 240.

Therefore, to allow a lower surface of the upper supporting plate 140 to safely come into contact with an upper surface of the loading unit 130, as shown in FIG. 2*a*, an upper footing 141 is formed as a horizontal block extending by a predetermined length in a longitudinal direction and integrally formed with a lower portion of an upper support 142 with reference to FIG. 3*a*, wherein the upper support 142 is formed as, for example, a vertical wall so that a lateral surface thereof is connected with the existing vertical part 230, and an upper surface thereof is connected with the existing slab 240.

Since the preloading apparatus 100 for adjusting a load according to the present invention is constructed before an extension of the existing structure 200, the existing loads transferred from the existing vertical part 230 and the existing slab 240 may be distributed to both the existing pile 210 and the new pile 110 and supported thereon.

Even when the extension of the existing structure 200 is performed, the existing load and the extension load are also distributed and transferred to both the existing pile 210 and the new pile 110, and thus the existing pile 210 and the new pile 110 may efficiently share the loads.

In this case, since the existing footing 220 and the new footing 120 are separate from each other and move separately, a load sharing rate of the new pile 110 is increased through adjustment of the preloading load, and thus reinforcement efficiency can be increased arbitrarily.

Further, in the case of FIG. 2*b*, the upper support 142 is formed on a lower portion of the upper supporting plate 140, and the upper footing 141 is integrally formed with an upper portion of the upper support 142, and it can be confirmed that the upper supporting plate 140 in various forms having the same functions may be constructed to be integrated with the existing vertical part 230 and the existing slab 240.

The existing structure 200 includes the existing pile 210, the existing footing 220, the existing vertical part 230, and the existing slab 240.

The existing pile 210 is constructed in the ground G in advance, and a head part of the existing pile 210 is integrated with the existing footing 220.

When an extension of an existing structure, such as an apartment, is built, an extension load is generated. When the thickness of the existing footing 220 is increased so that the existing footing 220 bears the extension load, a dead load is increased so that the loads exceed a reaction force of the existing pile 210.

According to the conventional preloading method, unlike the present invention, when the existing footing 220 or an extended footing integrated with the existing footing 220 is constructed before the extension of a building and a new pile is constructed, loss of the applied preloading load occurs. In this case, there is no way to adjust the loss of the preloading load, and a problem occurs that the load is not efficiently shared such as an increase in load sharing rate of the existing pile 210.

That is, in the present invention, since the existing vertical part 230 and the existing slab 240 are integrated with the upper supporting plate 140, the existing and extension loads are clearly transferred to the new pile 110 through the upper supporting plate 140, the loading unit 130, and the new footing 120, and the new pile 110 is constructed minimally due to adjustment of the load sharing rate, and thus economic feasibility is secured. Therefore, the loading unit 130 is exposed to freely restore the lost preloading load through adjustment of the preloads.

The existing vertical part 230, which is formed as a vertical wall or a column, is integrated with the upper supporting plate 140 to serve as a reaction bed of the loading unit 130 and a load transfer path and serves to transfer the existing and extension loads, which are transferred to the existing slab 240, to the new pile 110.

Therefore, as shown in FIGS. 2*a* and 2*b*, unlike the conventional preloading method, the loading unit 130 may adjust the preloading load at a required point of time, and the new footing 120 is constructed to be separate from the existing footing 220 to perform load sharing adjustment of the new pile 110 before and after an extension of the existing structure so as to minimize construction of the new pile, and thus economic feasibility and application efficiency of preloading load can be secured.

FIGS. 3*a* and 3*b* illustrate a footing reinforced using the preloading apparatus 100 for adjusting a load according to one embodiment of the present invention.

In FIG. 3*a*, in the existing structure 200, such as an apartment, a head part of the existing pile 210 is integrally constructed with the existing footing 220, the existing vertical part 230 continuously extends on the existing footing 220 in a longitudinal direction of the existing footing 220, and the existing slab 240 is formed on an upper surface of the existing vertical part 230.

Therefore, the existing footing 220 and the existing slab 240 may become an underground structure, such as an underground parking lot or a machine room, and when vertical or horizontal extension is built on an upper surface of the existing slab 240, the loads may be applied so that the reaction force of the existing pile 210 exceeds design bearing capacity.

Therefore, the new pile 110 is constructed in the ground next to the existing footing 220 to be separate from the existing footing 220 in a longitudinal direction and the new footing 120 having a single footing form may be constructed on the head part of the new pile 110 to be separate from the existing footing 220 in a longitudinal direction.

In this case, the new footing 120 is not in contact with the existing footing 220 and is constructed to be separate from the existing footing 220 so that a load is not transferred from the existing footing 220 to the new footing 120 and the new footing 120 and the existing footing 220 move separately.

Therefore, the new lower support 121 is installed on an upper surface of the new footing 120 and distributes the existing and extension loads, which are transferred from the loading unit 130, and transfers the loads to the new footing 120.

The new lower support 121 may be formed to be separate from the new footing 120 but moves integrally with the new footing 120 when a load is transferred.

The loading unit 130 is installed on an upper surface of the new lower support 121, and at least one loading unit 130 is installed to correspond to the new footing 120 having a single footing form.

Next, the upper supporting plate 140 connected with the existing vertical part 230 and the existing slab 240 is constructed so that the loading unit 130 is positioned under the upper supporting plate 140.

Therefore, the upper footing 141 is formed as a block to extend by a predetermined length in a longitudinal direction and corresponds to the new lower support 121, and the upper support 142 is formed as a vertical wall form integrally formed with a lower portion of the upper footing 141, wherein the upper support 142 may be integrated with the existing vertical part 230 and the existing slab 240.

The loading unit 130 is positioned between a lower surface of the upper footing 141 and an upper surface of the new lower support 121, and when the loading unit 130 operates, the existing and extension loads are transferred.

Since the loading unit 130 may be controlled, the preloading load may be precisely applied, and an additional load may be applied later on.

Further, the loading unit 130 may be removed to be replaced with a permanent support (not shown), and when needed, the loading unit 130 may be re-mounted for reuse.

In FIG. 3*a*, the existing footing 220 is separate from the new footing 120 to receive a load that is transferred from the existing vertical part 230 and the existing slab 240 as before, and the upper supporting plate 140 is connected with the existing vertical part 230 and the existing slab 240 so that the existing and extension loads are transferred to the upper supporting plate 140 through the existing vertical part 230 and the existing slab 240 and are finally transferred from the upper supporting plate 140 to the new pile 110 through the loading unit 130, the new lower support 121, and the new footing 120.

Next, in FIG. 3*b*, unlike the new footing 120 and the new lower support 121 formed as a single footing in FIG. 3*a*, a new footing 120 and a new lower support 121 are formed as a strip footing, and an upper supporting plate 140 is also formed as a strip footing.

That is, even in FIG. 3*b*, a head part of the existing pile 210 of the existing structure 200, such as an apartment, is constructed integrally with an existing footing 220, and the existing vertical part 230 continuously extends on the existing footing 220 in a longitudinal direction, and the existing slab 240 is formed on an upper surface of the existing vertical part 230.

The existing footing 220 and the existing slab 240 become an underground structure, such as an underground parking lot or a machine room, and when a vertical or horizontal extension is built on the existing slab 240, the loads may be applied so that the reaction force of the existing pile 210 exceeds design bearing capacity.

Therefore, new piles 110 are first constructed in the ground next to the existing footing 220 to be separate from each other in a longitudinal direction, and the new footing 120 having a strip footing form may be constructed on the head part of the new piles 110 to be separate from the existing footing 220 in a longitudinal direction.

In this case, the new footing 120 is also not in contact with a lateral side of the existing footing 220 and is separately constructed so that a load is not directly transferred from the existing footing 220, and the new footing 120 and the existing footing 220 move separately.

Further, the new lower support 121 is continuously installed on an upper surface of the new footing 120 in a strip footing form to distribute the extension load transferred from the loading unit 130 and serves to transfer the extension load to the new footing 120.

Even when the new lower support 121 is also formed separately from the new footing 120, the new lower support 121 and the new footing 120 may move integrally when a load is transferred.

The loading unit 130 is installed on an upper surface of the new lower support 121, and a plurality of loading units 130 are installed on the new footing 120 continuously extending in a longitudinal direction to be separate from each other.

Next, the upper supporting plate 140 integrated with the existing vertical part 230 and the existing slab 240 is constructed, and the upper supporting plate 140 includes an upper footing 141 having a horizontal plate form and upper supports 142, which are formed as a vertical wall on an upper surface of the upper footing 141 to be separate from each other in a longitudinal direction, and is formed as a wall member having a U-shaped cross-section.

In this case, the upper footing 141 is formed as a horizontal plate extending in a longitudinal direction and corresponds to the new lower support 121, and the upper support 142 having a vertical wall form is integrated with the existing vertical part 230 and the existing slab 240.

Therefore, the loading unit 130 is positioned between a lower surface of the upper footing 141 and an upper surface of the new lower support 121, and when the loading unit 130 operates, the existing and extension loads are transferred.

Since the loading unit 130 may be controlled, the preloading load may be precisely applied, and an additional load may be applied later on. Further, the loading unit 130 is removed to be replaced with a permanent support, and when needed, the loading unit 130 may be re-installed for reuse.

Therefore, similarly, even in FIG. 3*b*, the existing footing 220 is separate from the new footing 120 and receives a load from the existing vertical part 230 and the existing slab 240 as before. The upper supporting plate 140 is integrated with the existing vertical part 230 and the existing slab 240 so that the existing and extension loads are transferred to the upper supporting plate 140 through the existing vertical part 230 and the existing slab 240 and are transferred from the upper supporting plate 140 to the new pile 110 through the loading unit 130, the new lower support 121, and the new footing 120. The upper supporting plate 140 may be formed in a structure having a U-shaped cross-section.

Figure 4A:
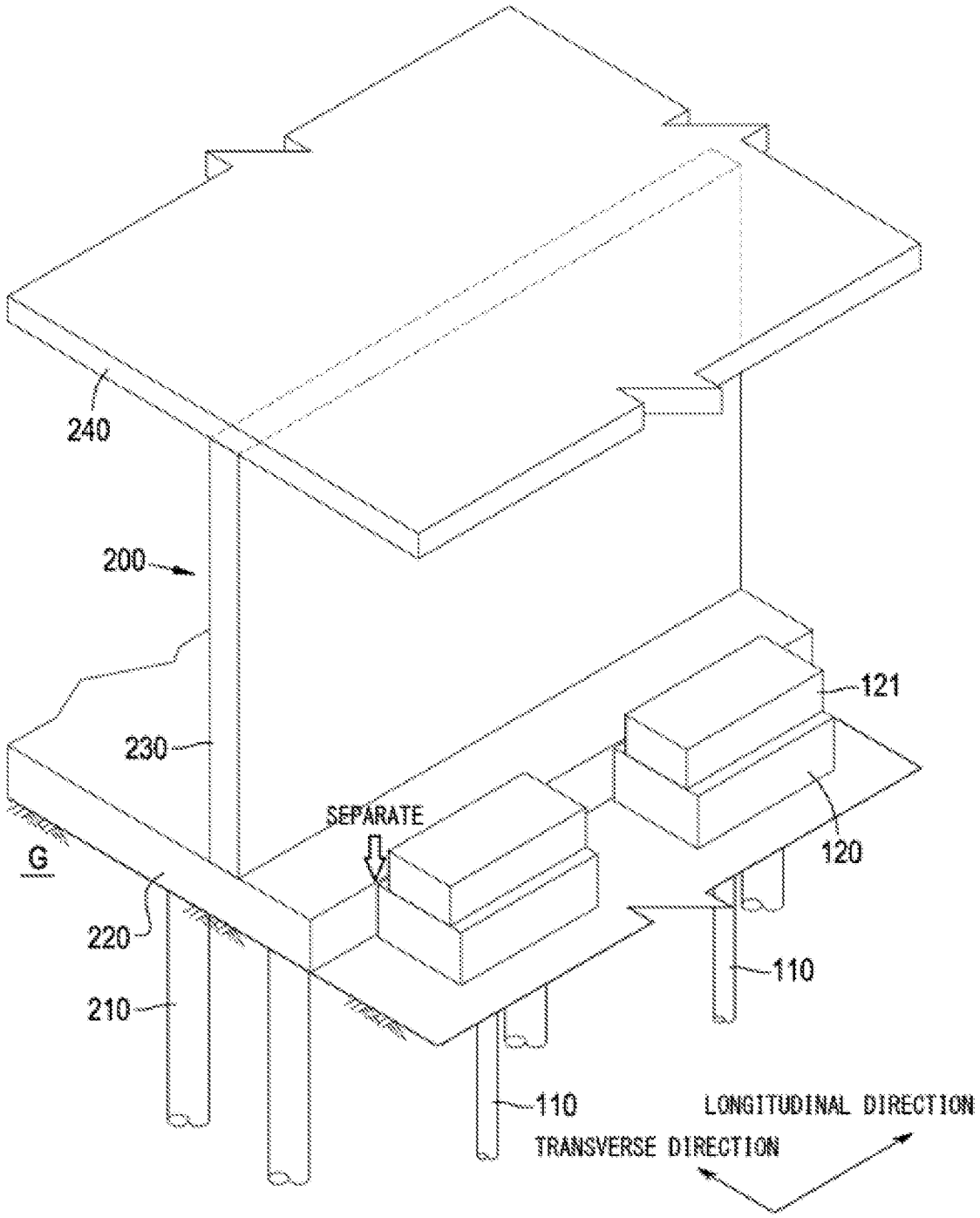
FIGS. 4*a* and 4*b* are views illustrating processes of a method of reinforcing a foundation using the preloading apparatus for adjusting a load according to the present invention.
Figure 4B:
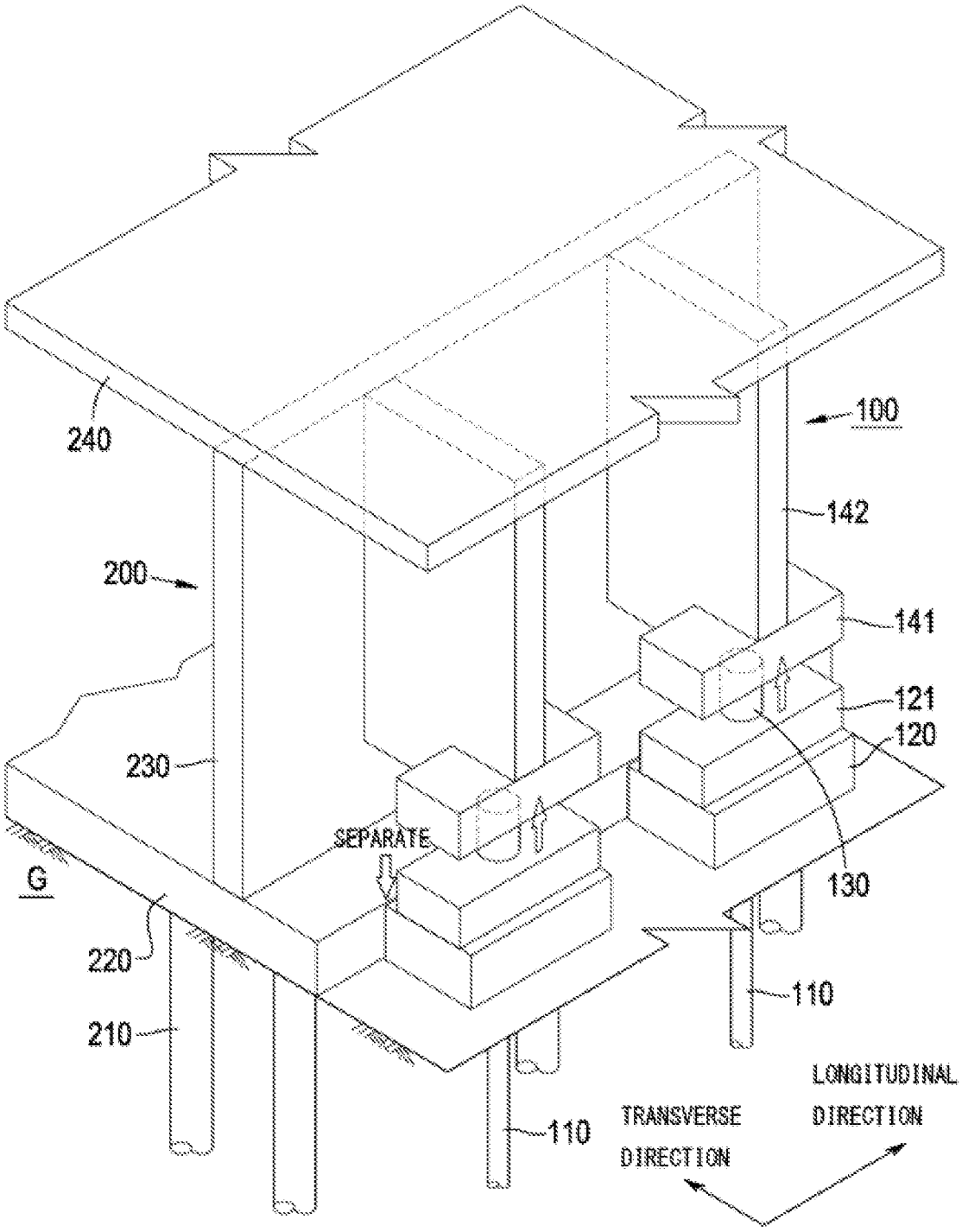

Method of Reinforcing a Foundation Using a Preloading Apparatus 100 for Adjusting a Load FIGS. 4*a* and 4*b* illustrate a process of the method of reinforcing a foundation using the preloading apparatus 100 for adjusting a load according to the present invention.

First, to construct the preloading apparatus 100 for adjusting a load that is constructed when an extension of an existing structure 200 is built, a new footing 120 is constructed using cast-in-place concrete to be separate from an existing footing 220, an upper supporting plate 140 is constructed to be connected with an existing vertical part 230 and an existing slab 240, and a preloading load is applied to a new pile 110 by a loading unit 130 in a reaction force manner.

As shown in FIG. 4*a*, the existing structure 200, which includes the existing pile 210, the existing footing 220, the existing vertical part 230, and the existing slab 240, is already constructed.

Therefore, the existing pile 210 receives an existing load transferred from above the existing vertical part 230 and the existing slab 240, and when an extension of an existing structure, such as an apartment, is built, horizontal and vertical extensions are performed, and thus the existing load and the extension load cannot be safely supported on only the existing pile 210 and the existing footing 220.

As shown in FIG. 4*a*, the plurality of new piles 110 are constructed in the ground next to the existing footing 220 to be separate from each other in a longitudinal direction.

Micro-piles are used as the new pile 110 and are constructed to a predetermined depth, and a front end of the new pile 110 may be supported on a hard support layer.

Since the micro-piles have a predetermined length, the micro-piles may be connected with each other by a coupler when needed. The micro-piles may be press-fitted into the ground by rotating according to a site condition or may be inserted into excavation holes and the excavation holes filled with a filling material for finishing.

Concrete is poured on arranged reinforcement bars to a predetermined thickness so that head parts of the micro-piles are buried, and thus the new footing 120 is formed. In FIG. 4*a*, the new footings 120 are constructed in a single footing form, but as shown in FIG. 3*b*, the new footings 120 may be constructed in a strip footing form continuously constructed in a longitudinal direction.

The new footing 120 is constructed to be separate from and not in contact with the existing footing 220 so that the new footing 120 and the existing footing 220 move separately.

Next, a new lower support 121 may be further integrally formed with an upper portion of the new footing 120 or additionally installed thereon so that a preloading load according to operation of the loading unit 130 is distributed and transferred to the new footing 120.

Next, as shown in FIG. 4*b*, the upper supporting plate 140 is integrally formed with the existing vertical part 230 and the existing slab 240 of the existing structure 200.

As shown in FIG. 3*a*, in the upper supporting plate 140, an upper footing 141 is formed as a block extending at a predetermined length in a longitudinal direction, and an upper support 142 is formed as a vertical wall integrally formed with a lower portion of the upper footing 141, wherein the upper support 142 is integrated with the existing vertical part 230 and the existing slab 240, but as shown in FIG. 3*b*, may use a wall member having a U-shaped cross-section.

The loading unit 130 is installed above the new footing 120 between the new lower support 121 and the upper supporting plate 140.

When the loading unit 130 is operated, the existing vertical part 230, the existing slab 240, and the upper supporting plate 140 serve as reaction beds and allow a preloading load to be applied to the new pile 110.

When needed, the loading unit 130 is re-operated to add a load or restore the lost preloading load later on.

Therefore, when an extension of a building is completed, the existing load and the extension load are applied. Since the existing footing 220 is separate from the new footing 120, the existing pile 210 shares a part of the existing load and the extension load, and the remaining existing load and extension load are finally transferred to the new pile 110, and thus the loads can be efficiently shared. When a reaction force of the existing pile exceeds design bearing capacity, an additional preloading load may be applied to the new pile, and thus the existing pile can be more effectively reinforced through adjustment of the preload.

The above description is only exemplary, and it should be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims and encompasses all modifications or alterations derived from meanings, the scope, and equivalents of the appended claims.

What is claimed is:

1. A preloading apparatus for adjusting a load, comprising:

a new footing which is separate from and not in contact with an existing footing and constructed in the ground;

an upper supporting plate which is integrated with an existing slab and an existing vertical part, which are formed on the existing footing, and formed above the new footing; and a loading unit installed between the new footing and the upper supporting plate, wherein, when the loading unit is operated, the upper supporting plate connected with the existing vertical part and the existing slab is used as a reaction bed so that a preloading load is applied to a new pile of the new footing, and thus the new pile shares an existing load and an extension load applied before and after an extension of a building through the existing vertical part and the existing slab so as to adjust the preload, and the loading unit is installed between the new footing and the upper supporting plate to serve to apply a preloading load to the new pile and adjusts the preloading load by repeatedly adding a preloading load at different times.

2. The preloading apparatus of claim 1, wherein the new pile is constructed in a manner in which the new pile is rotatably pressed-fitted into the ground next to the existing footing or is inserted into an excavation hole and the excavation hole is filled with a filling material, wherein a head part of the new pile is integrally buried in the new footing, and the new pile is provided as a plurality of new piles formed to be separate from each other in a longitudinal direction.

3. The preloading apparatus of claim 2, wherein the new footing is provided as a plurality of new footings each formed in the ground as a single footing to be separate from each other in a longitudinal direction, or the new footings are each formed in the ground as a strip footing continuously extending in a longitudinal direction.

4. The preloading apparatus of claim 1, wherein the loading unit is adjusted in a manual or automatic manner and a wired or wireless manner using a mechanical device or a hydraulic jack and a control system.

5. The preloading apparatus of claim 1, wherein, in the upper supporting plate, an upper support is integrated with the existing vertical part and the existing slab of an existing structure, and an upper footing is integrally formed with a lower portion of the upper supporting plate so that a lower surface of the upper footing is in contact with an upper surface of the loading unit.

6. The preloading apparatus of claim 1, wherein, in the upper supporting plate, an upper footing is integrated with the existing vertical part and the existing slab of an existing structure, and an upper support is integrally formed with a lower portion of the upper footing so that a lower surface of the upper support is in contact with an upper surface of the loading unit.

7. The preloading apparatus of claim 1, wherein the upper supporting plate is formed in a vertical wall in which an upper footing is formed as a block extending by a predetermined length to correspond to a new lower support and is integrally formed with a lower portion of an upper support, and the upper support is integrated with the existing vertical part and the existing slab.

8. The preloading apparatus of claim 1, wherein the upper supporting plate comprises an upper footing having a horizontal plate form and an upper supports, which are formed on an upper surface of the upper footing in a vertical wall form and spaced apart from each other and are formed as a wall member having a U-shaped cross-section, wherein the upper footing is formed as an extending horizontal plate to correspond to a new lower support, and the upper supports having a vertical wall form are integrated with the existing vertical part and the existing slab.

9. A method of reinforcing a foundation using a preloading apparatus, comprising:

(a) constructing a new pile in the ground to be separate from and not in contact with an existing footing and integrating the new pile with a new footing;

(b) integrating an upper supporting plate with an existing slab and an existing vertical part, which are formed in the existing footing, to be positioned above the new footing; and (c) installing a loading unit between the new footing and the upper supporting plate and operating the loading unit to apply a preloading load to the new pile of the new footing by using the upper supporting plate, which is connected with the existing vertical part and the existing slab, as a reaction bed, wherein, in operation (c), since the loading unit is installed between the new footing and the upper supporting plate, the loading unit allows the preloading load to be adjusted by repeatedly adding a preloading load at different times.

10. The method of reinforcing a foundation using a preloading apparatus of claim 9, wherein the new pile in operation (a) is constructed in a manner in which a micro-pile is directly rotatably pressed-fitted into the ground under a portion at which the new footing is formed, or in a manner in which an excavation hole is made, the micro-pile is inserted into the excavation hole, and the excavation hole is finished with a filling material, wherein the new pile is provided as a plurality of new piles installed to be separate from each other.

11. The method of reinforcing a foundation using a preloading apparatus of claim 9, wherein, in operation (c), when a mechanical device that vertically extends or a hydraulic jack and a control system are used as the loading unit, the loading unit is controlled in a manual or automatic manner and a wired or wireless manner so as to allow the new pile to share an existing load and an extension load applied through the existing vertical part and the existing slab before and after an extension is built.

12. The method of reinforcing a foundation using a preloading apparatus of claim 9, wherein, in the upper supporting plate in operation (b), an upper support is integrated with the existing vertical part and the existing slab of an existing structure, and an upper footing is integrally formed with a lower portion of the upper supporting plate so that a lower surface of the upper footing is in contact with an upper surface of the loading unit.

13. The method of reinforcing a foundation using a preloading apparatus of claim 9, wherein, in the upper supporting plate in operation (b), an upper support is integrated with the existing vertical part and the existing slab of an existing structure and is integrally formed with a lower portion of an upper footing so that a lower surface of the upper footing is in contact with an upper surface of the loading unit.

* * * * *